US007419391B2

(12) United States Patent
Schmidt

(10) Patent No.: US 7,419,391 B2
(45) Date of Patent: Sep. 2, 2008

(54) CONNECTOR HOUSING WITH HOUSING COVER

(75) Inventor: Martin Schmidt, Luebbecke (DE)

(73) Assignee: Harting Electric GmbH & Co. KG (DE)

( * ) Notice: Subject to any disclaimer, the term of this patent is extended or adjusted under 35 U.S.C. 154(b) by 0 days.

(21) Appl. No.: 11/674,014

(22) Filed: Feb. 12, 2007

(65) Prior Publication Data

US 2007/0207659 A1 Sep. 6, 2007

(30) Foreign Application Priority Data

Mar. 2, 2006 (DE) ..... 20 2006 003 309 U

(51) Int. Cl.
*H01R 13/62* (2006.01)

(52) U.S. Cl. ..... 439/157

(58) Field of Classification Search ..... 439/152–160, 439/372, 341–343
See application file for complete search history.

(56) References Cited

U.S. PATENT DOCUMENTS 5,263,871 A 11/1993 Sano ..... 439/157
5,322,448 A * 6/1994 Hahn ..... 439/157
5,658,162 A 8/1997 Harting et al. ..... 439/372
6,814,606 B2 * 11/2004 Kobayashi ..... 439/372
7,070,438 B2 * 7/2006 Dillon ..... 439/347

FOREIGN PATENT DOCUMENTS

| | | |
|---|---|---|
| DE | 42 28 531 | 3/1993 |
| DE | 195 08 605 | 3/1995 |
| DE | 199 39 408 | 3/2001 |
| EP | 1 079 471 | 2/2001 |

* cited by examiner

*Primary Examiner*—Alexander Gilman
(74) *Attorney, Agent, or Firm*—Hayes Soloway P.C.

(57) ABSTRACT

In order to cover a connector housing and to interlock the connector housing with a mating connector, there is provided an integrated turning and interlocking mechanism having connecting elements arranged on the lateral surfaces of the connector housing wherein said connecting elements are guided on pins and connected to a pivoted housing cover that is arranged on the connector housing and provided for interlocking with the mating connector.

9 Claims, 3 Drawing Sheets

CONNECTOR HOUSING WITH HOUSING COVER

BACKGROUND OF THE INVENTION

1. Field of the Invention

The invention pertains to a connector housing with a pivoted housing cover that is attached to the connector housing and serves for closing the connector housing or for interlocking the connector housing with a compatible mating connector connected thereto.

A thusly designed connector housing is required in plug-type connections that are not utilized continuously in order to protect the electric contacts in the connector housing from environmental influences by means of a protective cap or, if the connector housing is connected to a corresponding mating connector, to interlock the plug-type connection by means of this protective cap.

2. Description of the Related Art

DE 195 08 605 C1 discloses an electric plug-type connector with interlocking hooks that are respectively arranged opposite of one another on the narrow sides, wherein one connector half is provided with locking pins that engage with rocker-like interlocking elements on the other connector half in order to interlock the two plug-type connector housings.

Such an interlocking mechanism, as well as other variations with an interlocking hook, are merely provided for interlocking a connector housing with a corresponding mating connector, wherein a separate protective cap is required for closing the connector housing.

SUMMARY OF THE INVENTION

The invention therefore is based on the objective of designing a connector housing of the initially cited type in such a way that the housing cover of the connector housing features a turning and interlocking mechanism that not only makes it possible to close the connector housing, but also to interlock the connector housing with a mating connector.

This objective is attained in that the connector housing with the housing cover attached thereto features on its respective lateral surfaces a turning and interlocking mechanism that cooperates with the mating connector, in that the turning mechanism consists of connecting elements as well as braces that are rotatably supported in pins laterally on the connector housing and in pins laterally on the housing cover, and in that the interlocking mechanism consists of a hook that forms an integral part of the connecting element and features a recess that can be engaged with a pin of the mating connector housing.

The advantages attained with the invention can be seen, in particular, in that the connector housing features a fixed housing cover for protecting the sensitive plug contacts from the environment, and in that the housing cover can be used, if the connector housing is connected to a corresponding mating connector, for interlocking the two connector housings.

To this end, correspondingly designed connecting elements that are respectively provided on the narrow side walls and guided on pins advantageously form a combined turning and interlocking mechanism, wherein the housing cover is turned about the longitudinal axis of the connector housing.

The position of the pivoting points and the length of the connecting elements are adapted to one another in such a way that an optimal predetermined pivoting curve of the housing cover not only makes it possible for the housing cover to fulfill the function of a protective cap for closing the connector housing, but also the function of interlocking the connector housing with a corresponding mating connector.

In order to interlock the connector housing with the mating connector, it is usually required to provide the mating connector with an additional engaging pin that engages into a recess of the connecting elements.

BRIEF DESCRIPTION OF THE DRAWINGS

One embodiment of the invention is illustrated in the figures and described in greater detail below. The figures show.

DETAILED DESCRIPTION OF THE INVENTION

Figure 1:
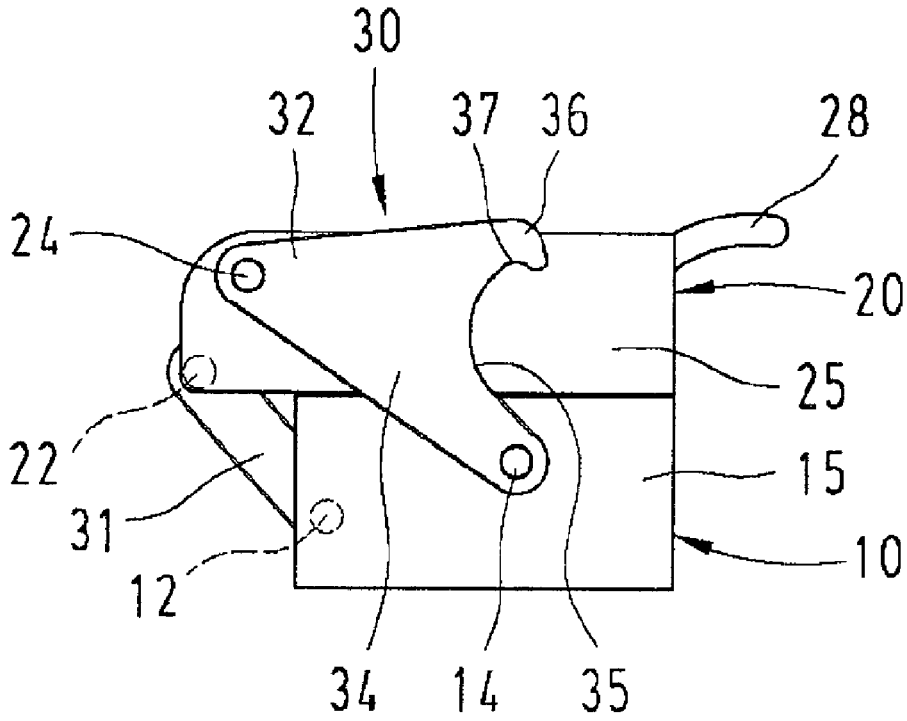
FIG. 1 is a plug-type connector housing with an interlocked cover in the form of a side view.

FIG. 1 shows a plug-type connector housing to be installed on an electric device in the form of a side view, in which only the essential characteristics are illustrated.

The plug-type connector housing 10 is shown with a closed housing cover 20, wherein the housing and the cover are connected to one another with connecting elements 30 arranged on each of the side walls. In this case, the side walls 15 and 25 are extended toward the rear side of the housing beyond the actual frame, in which a connector insert needs to be positioned. On its rear side, the housing cover 20 also protrudes over the plug-type connector housing 10.

On the rear side of the housing, a brace 31 is arranged between the side walls of the housing and of the cover and forms the actual turning mechanism of the connection by means of pins 12 on the connector housing 10 that are covered in this illustration and pins 22 on the housing cover.

In addition, one respective connecting element 30 is arranged on the side walls 15 and 25 by means of pins 14 and 24.

The connecting element 30 is realized in the form of a plane trilateral element and features a hook 36 formed out of a recess 35.

The connecting element 30 features a recess 35 between the pin 14 and the hook 36, but the two other sides 34 and 32 between the pins 14 and 24 and between the pin 24 and the hook 36 are realized straight.

The interlocked position shown can be unlocked by means of a handle 28 that forms an integral part of the front side of the housing cover, wherein the housing cover can be pivoted open to approximately 120°. The interlock with the housing is situated on the front side between the housing and the cover, but not illustrated in detail in this figure.

Figure 2:
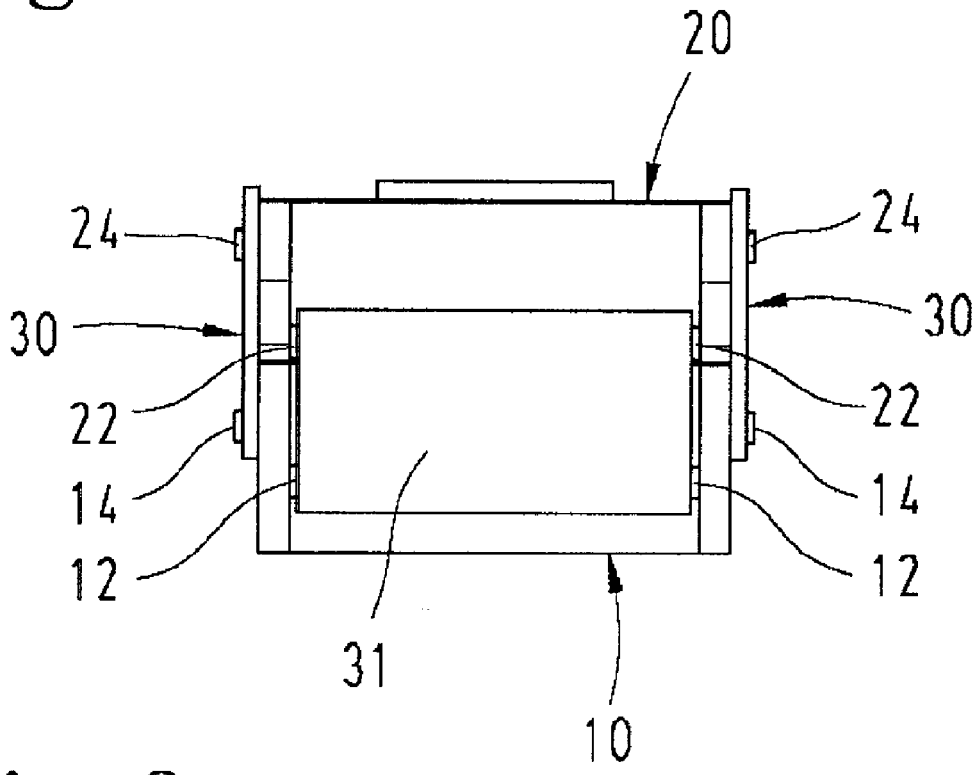
FIG. 2 is the plug-type connector housing viewed in the direction of the rear side of the housing.

FIG. 2 shows the rear side of the housing and cover combination, particularly with the brace 31 that extends over the entire rear side and the reference symbols that were already explained above with reference to FIG. 1.

Figure 3:
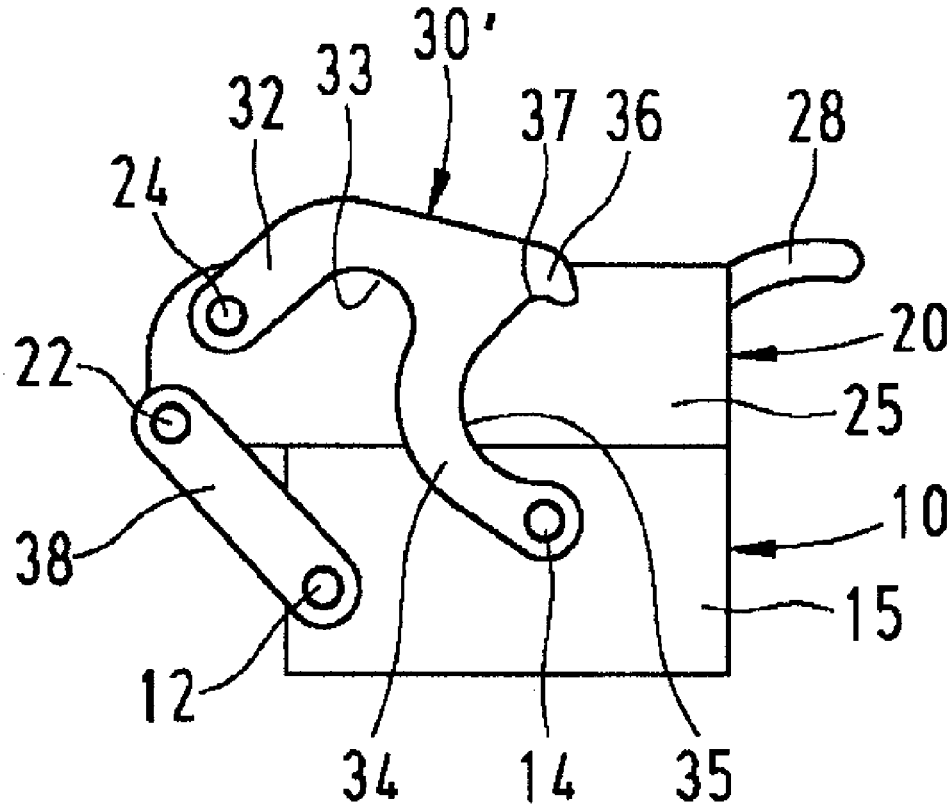
FIG. 3 is a variation of a plug-type connector housing that is closed with a housing cover.

FIG. 3 shows a variation of a plug-type connector housing according to FIG. 1 that is interlocked by means of a housing cover.

In this case, the turning mechanism is realized with the aid of one respective brace 38 that is arranged outside the side walls 15, 25 and supported in pins 12 and 22 that are visible in this figure.

The externally arranged braces 38 require a different shape of the connecting element 30'.

The connecting element 30' is realized identical to the connecting element 30 according to FIG. 1 in its pivoting points on the pins 14 and 24. The recess 35 as well as the resulting recess 37 with the hook 36 that protrudes over the engaging pin 26 are also identical.

Figure 4:
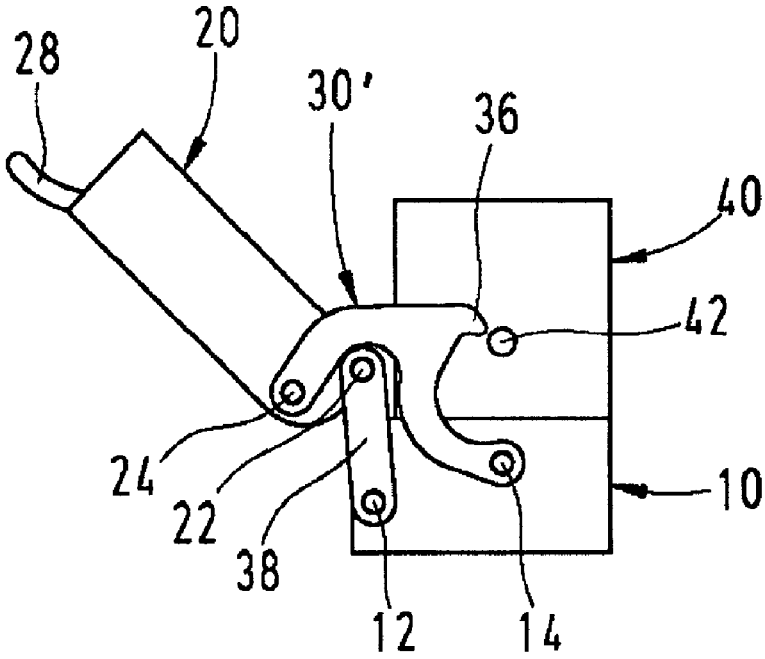
FIG. 4 is an opened plug-type connector housing with a mating connector connected thereto.

Another recess 33 is required on the line between the pins 14, 24, wherein this recess makes it possible to overlap the brace 38 and the pivoting point about the pin 22 when the housing cover 20 is opened as shown in FIG. 4.

This results in the substantially rounded limbs 32 and 34.

FIG. 4 shows a mating connector 40 with an engaging pin 42 that is connected to the connector housing 10, wherein the housing cover 20 is pivoted open to approximately 120°.

Figure 5:
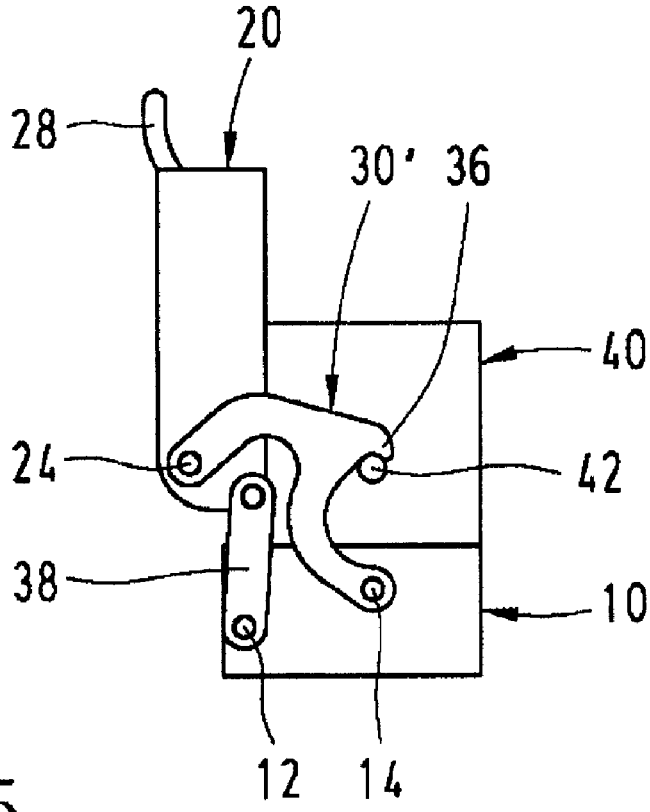
FIG. 5 is a plug-type connector housing that is interlocked with the mating connector.

If the housing cover 20 is pressed against the mating connector 40 as shown in FIG. 5, the hook 36 on the connecting element 30' slides behind the engaging pin 42 and engages therewith such that both connector housings 10, 40 are interlocked.

Consequently, the housing cover 20 can be used for protecting a connector insert in the connector housing 10 from environmental influences, as well as for interlocking the connector housing with a designated mating connector 40.

What is claimed is:

1. A connector housing with a pivoted housing cover that is attached to the connector housing and serves for closing the connector housing or for interlocking the connector housing with a compatible mating connector thereto, wherein the connector housing connected to the housing cover features on its lateral surfaces one respective turning and interlocking mechanism that cooperates with the mating connector, wherein the turning mechanism comprises connecting elements as well as braces that are retractably supported in pins laterally on the connector housing cover, wherein the interlocking mechanism comprises a hook one of on the connecting elements on which a recess is provided that can be engaged with a pin of the mating connector housing, wherein the one of the connecting element has a plane, essentially trilateral shape and is held on the pin on the connector housing with one limb and a bore arranged therein, and wherein the one of the connecting element is also held on a pin on the housing cover on another corner side.

2. The connector housing according to claim 1 wherein the brace is arranged centrally between elements underneath the rear side of the housing cover and held on the connector housing and on the housing cover with pins.

3. The connector housing according to claim 1, wherein the brace is arranged outside the lateral surfaces of the connector housing and of the housing cover and held on pins.

4. The connector housing according to claim 1, wherein another connecting element comprises two limbs and a hook.

5. The connector housing according to claim 4, wherein the other connecting element features a recess between the limbs.

6. A connector housing with a pivoted housing cover that is attached to the connector housing and serves for closing the connector housing or for interlocking the connector housing with a compatible mating connected thereto, wherein the connector housing connected to the housing cover features on its lateral surfaces one respective turning and interlocking mechanism that cooperates with the mating connector, wherein the turning mechanism comprises connecting elements as well as braces that are rotatably supported in pins laterally on the connector housing and in pins laterally on the housing cover, wherein the interlocking mechanism comprises a hook on one of the connecting elements on which a recess is provided that can be engaged with a pin of the mating connector housing, and further comprising another connecting element which comprises two limbs and a hook.

7. The connector housing according to claim 6, wherein the brace is arranged centrally between the connecting elements underneath the rear side of the housing cover and held on the connector housing and on the housing cover with pins.

8. The connector housing according to claim 6, wherein the brace is arranged outside the lateral surfaces of the connector housing and of the housing cover and held on pins.

9. The connector housing according to claim 6, wherein the other connecting element features a recess between the limbs.

* * * * *

UNITED STATES PATENT AND TRADEMARK OFFICE

CERTIFICATE OF CORRECTION

PATENT NO. : 7,419,391 B2
APPLICATION NO. : 11/674014
DATED : September 2, 2008
INVENTOR(S) : Schmidt It is certified that error appears in the above-identified patent and that said Letters Patent is hereby corrected as shown below:

Claim 1, Col. 3, line 37, "comprises a hook one of on the" should be --comprises a hook on one of the--.

Signed and Sealed this

Twentieth Day of January, 2009

JON W. DUDAS
*Director of the United States Patent and Trademark Office*